United States Patent [19]

Lehmann et al.

[11] 4,149,574

[45] Apr. 17, 1979

[54] APPARATUS FOR FILLING A HOLLOW AND CLOSED SYSTEM PROVIDED WITH ONLY ONE FILLING APERTURE

[75] Inventors: Wilfried Lehmann; Erwin Zimmermann, both of Heiligenstedten, Fed. Rep. of Germany

[73] Assignee: Sihi GmbH & Co., Fed. Rep. of Germany

[21] Appl. No.: 843,246

[22] Filed: Oct. 18, 1977

[30] Foreign Application Priority Data

Oct. 23, 1976 [DE] Fed. Rep. of Germany ..... 2648097

[51] Int. Cl.[2] ..... B65B 31/00

[52] U.S. Cl. ..... 141/59; 141/83; 62/77; 137/205; 165/71

[58] Field of Search ..... 141/7, 65, 66, 127, 141/59–61, 82, 83, 39–58; 62/77, 292; 137/205, 209; 165/71; 123/41.01, 41.54, 41.55

[56] References Cited

U.S. PATENT DOCUMENTS

| | | | |
|---|---|---|---|
| 3,507,308 | 4/1970 | White | 141/61 |
| 3,538,961 | 11/1970 | Bruce | 141/61 |

*Primary Examiner*—Houston S. Bell, Jr.

*Attorney, Agent, or Firm*—Prutzman, Kalb, Chilton & Alix

[57] ABSTRACT

Apparatus for selectively charging and evacuating a separate liquid system such as an engine cooling system, refrigeration system or the like and having a liquid storage tank, a single fluid pump and valve means for selectively connecting both the pump inlet and pump outlet for either pumping liquid from the storage tank via a connector conduit to the separate system or from the separate system via the connector conduit to the storage tank.

8 Claims, 5 Drawing Figures

Figure 2:
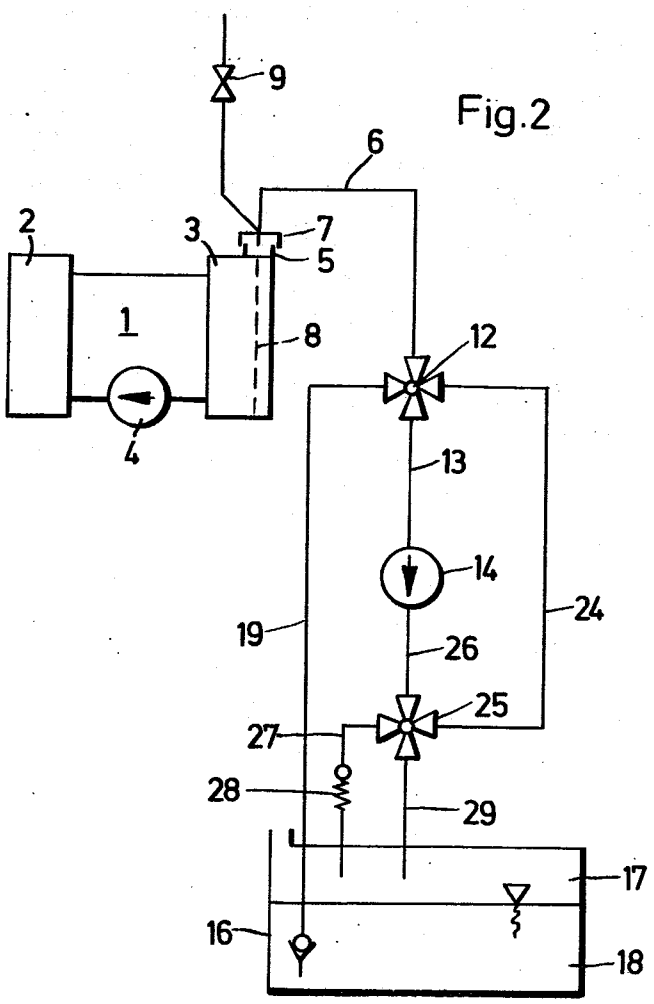

1
2
3
4
5
6
7
8
9
12
13
14
16
17
18
19
24
25
26
27
28
29

1
2
3
4
5
6
7
8
9
10
11
12
13
14
15
16
17
18
19
20
21
22
23

APPARATUS FOR FILLING A HOLLOW AND CLOSED SYSTEM PROVIDED WITH ONLY ONE FILLING APERTURE

This invention relates to an apparatus for filling a hollow and closed system provided with only one filling aperture such as an engine radiator unit or a refrigerator with liquid, in which the apparatus is provided with a connection pipe that is connectable to the filling aperture of the system, an evacuation pump that is connectable, on the delivery side, via a control facility, to the connection pipe, a filling pump that is connectable, directly or indirectly, on the pressure side, via a control facility, to the connection pipe, as well as with a storage tank for the liquid.

A known apparatus for the filling of hollow and closed systems comprises two pumps, that is to say, one evacuation pump for evacuating the system and one liquid pump for filling the system, in which the interaction between the two pumps takes place contingent upon both pressure and time with the aid of control facilities. The known apparatus is efficient enough for automobile factories, it is, however, too expensive for smaller workshops and service stations.

For this reason it is the object of this invention to provide an apparatus of the aforementioned kind which is less expensive than the known apparatus. However, just as the latter, it must be capable of adequately evacuating the system to be filled in order to thereby reduce the risk of an incomplete filling operation due to air pockets. In addition, it should ensure a rapid filling of the system and, if necessary, permit a leak test to be carried out.

The solution according to the invention consists in that provision has been made for one pump only and in that the control facilities are designed in such a manner that, for the evacuation operation, the pump is connectable on the suction side to the connection pipe and, for the filling operation, it is connectable on the pressure side to the connection pipe.

Since provision has been made for one pump only, the apparatus is significantly cheaper and simpler than the known apparatus. The sole pump functions either as a vacuum pump in the evacuation operation or as a pressure pump in the filling operation. It also has a double function, in which the changeover from one function to the other is brought about with the aid of the control facilities that are constructed in such a way that the line connections of the respective modes of operation are changed accordingly.

The apparatus according to the invention is intended to be used primarily for the filling of radiator units of motor vehicles. However, to all intents and purposes, it is suitable to be used for the filling of any hollow and closed system in which an evacuation operation precedes the filling operation with liquid. Within the meaning of the invention, a hollow system is regarded as being closed which, in the course of both the evacuation and the filling operation, it is possible to seal off from the atmosphere and which is connected to the filling device solely via its filling aperture. Generally speaking, by an evacuation is meant the exhaustion of the air contained in the system until a moderate vacuum is achieved. The apparatus should, however, also be generally capable of removing a filling with liquid that may possibly be present in the system while simultaneously producing the vacuum. By control facilities are meant line shutoff devices that are designed in particular as multi-way valves and which may be operated either manually or by automatic means. It is conceivable, of course, to connect the pressure side of the pump during the filling operation directly to the connection pipe and, thereby, to the system to be filled, whereby the suction side of the pump is connected to the storage tank. However, preference is given to a model in which the pump does not feed directly into the system, but increases the pressure inside the storage tank, the liquid chamber of which is connected to the connection pipe. For this purpose, the control facilities are constructed in such a manner that, for the filling operation, the pressure side of the pump is connectable to the storage tank which is sealed off from the atmosphere and the liquid chamber of the storage tank is connectable to the connection pipe. By means of the pump feeding into the storage tank, the air present above the lower section (liquid chamber) of the storage tank (pressure chamber) is compressed so that the liquid from the storage tank is urged gently, via the connection pipe, into the system to be filled. For this function it suffices if the storage tank is sealed off from the atmosphere only during the filling operation, which can be effected with the aid of appropriate control facilities.

The air chamber of the storage tank is expediently connected to an excess pressure valve that can be set to the filling pressure. It is prevented hereby that the system is endangered by an excessive filling pressure.

When, as described in the foregoing, the filling pressure is produced by compressing the air inside the air chamber of the storage tank, the building up of the filling pressure and, with it, the filling time, is contingent upon the size of the pressure chamber. For this reason the pressure chamber is expediently designed to be as small as possible. However, the volume of the air chamber in a storage tank does of course change according to the varying volume of the reserve of liquid contained therein. In order, on the one hand, to be able to store a sufficiently large reserve of liquid and, on the other hand, in order to continually form a small pressure chamber, it is advantageous in accordance with the invention if the storage tank is divided up into a small, pressure-resistant section that is connectable to the pressure side of the pump and to the connection pipe, and a larger section that communicates with the atmosphere, in which a connecting aperture between both sections can be shut off for the filling operation. The smaller, pressure-resistant section does not need to be any larger than is necessary for the accommodation of the volume of liquid requisite for one filling operation or a few filling operations. On the other hand, the other section of the storage tank may be of any size desired and may be constructed without taking the size of the pressure chamber into consideration. This model also possesses the advantage that only a small portion of the storage tank has to be pressure-resistant and, accordingly, will be less expensive to construct.

The construction may be arranged in such a way that the suction side of the pump is immediately connectable to the connection pipe, the pump being of a type that is suitable for feeding both liquid and gas. By way of example, it may be a side channel pump or a liquid ring pump. This type renders possible both the evacuation of systems filled with liquid as well as the evacuation of systems filled solely with air.

However, in many instances it is preferred that the suction side of the pump is connectable to the connection pipe via a liquid collecting vessel. When liquid is drawn off by suction from the system it does not pass directly into the pump, but remains in the collecting vessel while the pump exclusively draws in gas by suction. This permits the employment of types of pumps which are essentially equipped only for feeding gas or which function most effectively when feeding gas.

The said liquid collecting vessel may be constituted of the storage tank, in which case the storage tank is constructed appropriately resistant to partial vacuum and, for the evacuation operation, is connectable, on the one hand, to the connection pipe and, on the other hand, is connectable with its air chamber to the suction side of the pump.

The apparatus according to the invention may be fitted with an excess pressure leak testing device and/or a partial vacuum leak testing device. Devices of this kind are known. By way of example, they consist of a pressure-measuring means connected to the connection pipe and of a shutoff means which permits the section of the connection pipe that communicates with the system and fitted with the pressure-measuring means to be shut off from the other parts of the apparatus. When the partial vacuum test is carried out, it is determined subsequent to the evacuation operation whether, in the system and in the connected section of the connection pipe, the pressure increases during a specific period of time to such an extent that a leakage in the system can be inferred therefrom. When carrying out the excessive pressure test, after the apparatus has been filled, for so long as the same is under excessive pressure together with the connected section of the connection pipe, a check is made as to whether the excessive pressure drops to an unduly great extent. The partial vacuum or excessive pressure necessary for these tests is likewise produced, either as evacuation or filling pressure, by the sole pump of the apparatus according to the invention.

Figure 3:
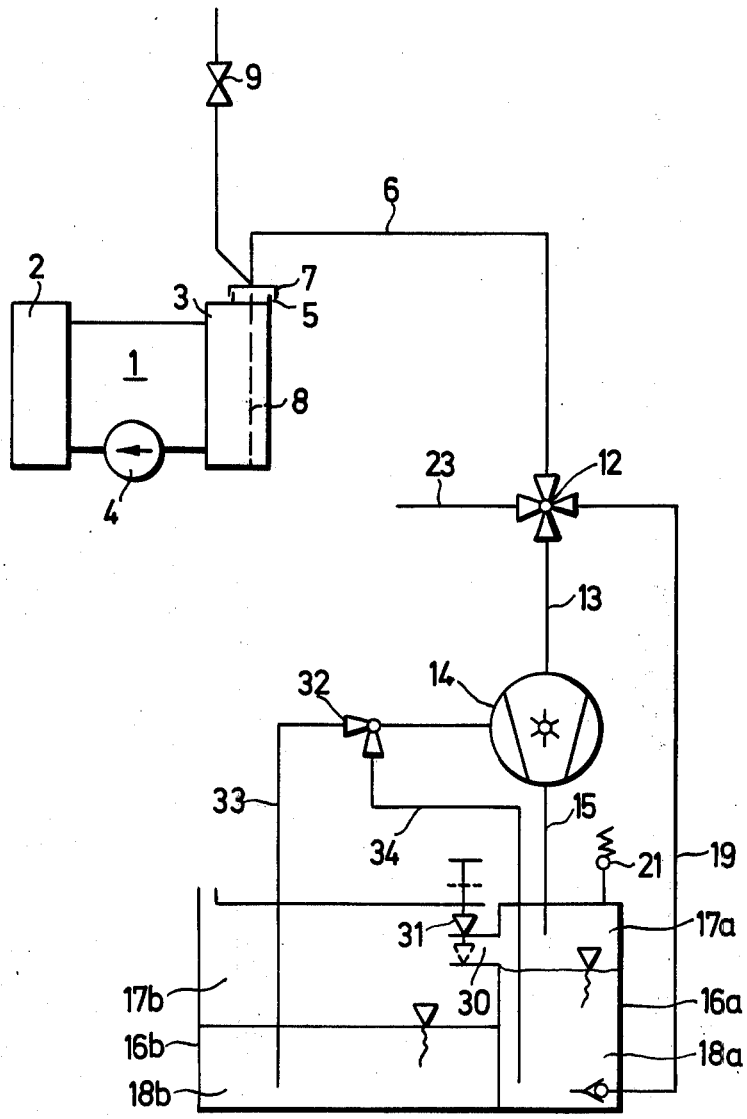
Figure 4:
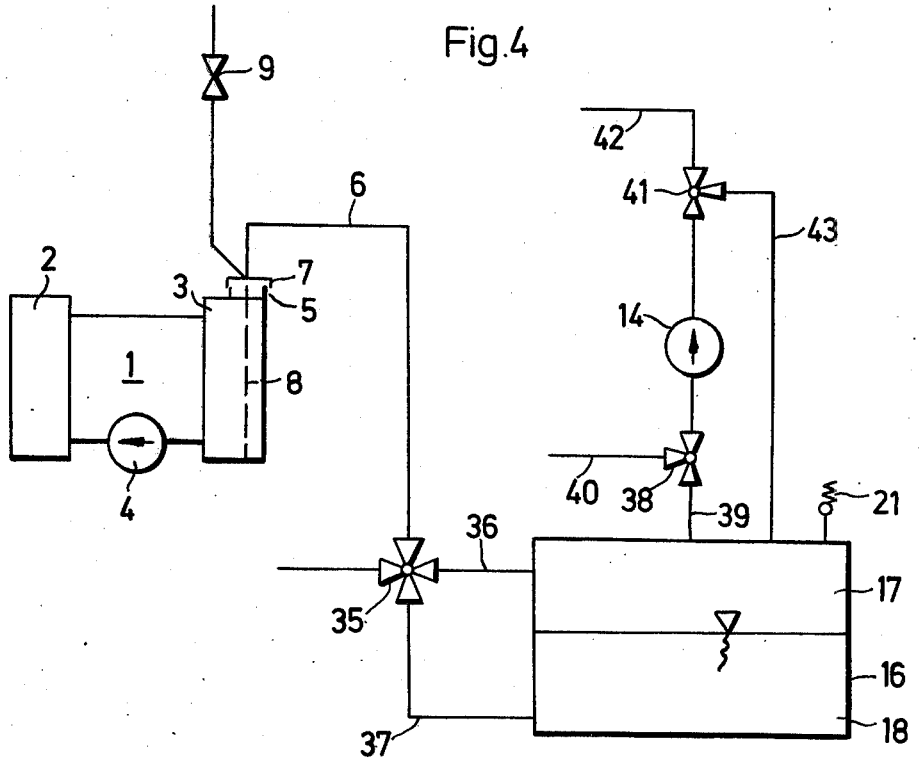
Figure 5:
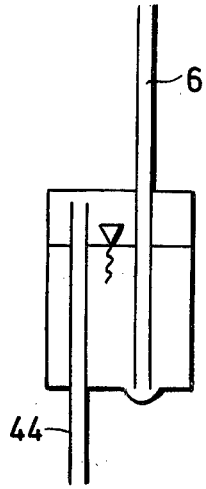

In the following the invention is described in greater detail while reference is made to the embodiment examples illustrated in the drawings, of which FIGS. 1–4 show diagrams of various embodiment examples, and FIG. 5 shows a liquid collecting vessel.

In all the figures, 1 represents the system to be filled which, by way of example, consists of two heat exchangers 2, 3, a circulating pump 4 and a filler neck 5. It is irrelevant whether the system possesses additional aperture possibilities at other points, provided that these can be shut off in a sealing manner during the evacuation and filling operations.

At the extremity of connection pipe 6 of the filling device a connecting piece 7 is provided which is closely connectable to filler neck 5. The connecting piece 7 may project deeply into the system with a hollow lance 8 connected to connection pipe 6, in order to draw out liquid by suction.

The connection pipe 6 is, immediately at the connecting piece 7, connected to a ventilating valve 9 which permits the apparatus to be rendered pressureless after use. When, subsequent to the filling operation, the liquid is simultaneously withdrawn by suction from the connection pipe into the apparatus, it will be possible to detach the connecting piece 7 from the filled system without any dripping taking place. According to FIG. 1, inside connection pipe 6 are additionally indicated a valve 10 and a pressure-measuring means 11, which are intended to be used for the leak test. They may also be comprised in the apparatuses illustrated in the other figures without that an additional explanation is required.

Figure 1:
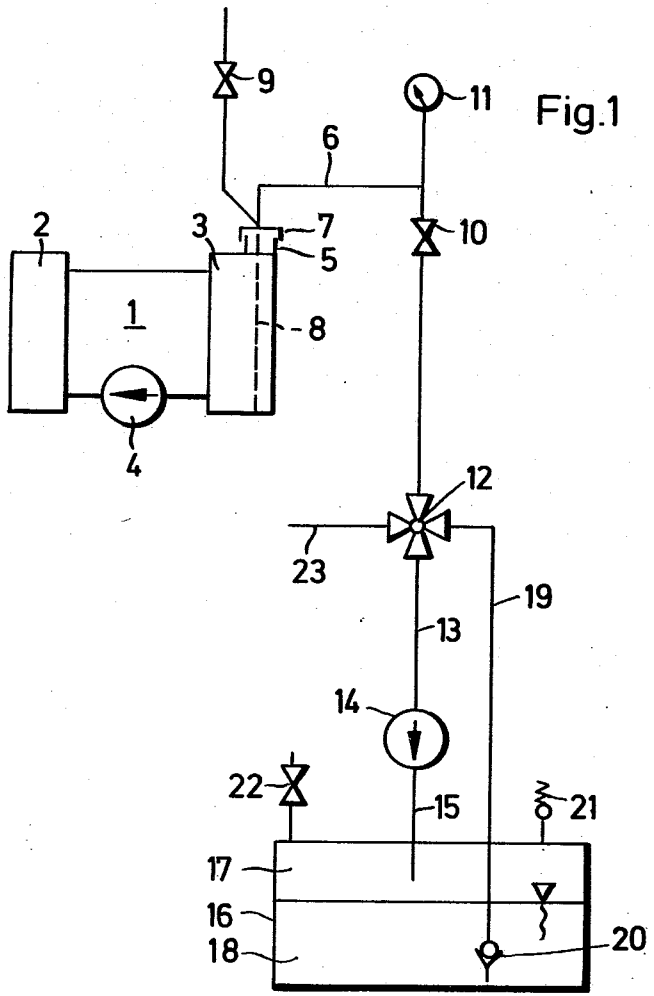

In the embodiment example of FIG. 1, the connection pipe 6 is connected to the suction side of pump 14 via the multi-way valve 12 and line 13. Line 15 leads from the delivery side of pump 14 into the storage tank 16, the upper portion of which is filled with air in its capacity as pressure chamber 17, while its lower portion 18 constitutes the liquid chamber. It is possible, moreover, to connect the connection pipe 6 with the aid of multi-way valve 12 to a line 19 that leads into the liquid chamber 18 of the storage tank 16 and which is, by means of a check valve 20, equipped to convey liquid from the storage tank 16 to the connection pipe 6.

The pressure chamber 17 is provided with an excess pressure valve 21, which is set to the filling pressure. In addition, the pressure chamber 17 may be made to communicate with the atmosphere by means of valve 22.

The multi-way valve 12 is connected to a line 12 which leads to the atmosphere.

The apparatus as shown in FIG. 1 functions in the following manner.

Subsequent to connecting piece 7 having been placed upon the filling aperture, valves 10 and 22 are opened, valve 9 is closed and the multi-way valve 12 is adjusted in such a way that pipe 6 is connected to line 13. Hereby pump 14 evacuates the system 1, whereby the medium conveyed arrives in the storage tank 16. The pumped-away liquid is fed to the reserve of liquid, while the air escapes into the atmosphere via valve 22. When an adequate vacuum has been obtained in the system 1, it will be possible to carry out the leak test in that valve 10 is closed and the pressure-measuring means 11 is kept under observation for a certain period of time. Following this, the filling operation may be initiated manually or automatically by opening valve 10, closing valve 22 and by adjusting the multi-way valve 12 in such a way that connection pipe 6 is connected to line 19, while the suction line 13 of the pump communicates with the atmosphere via line 23. Pump 14 now feeds atmospheric air into the pressure chamber 17 which remains shut off from the atmosphere for so long as the filling pressure is not reached to which the excess pressure valve 21 has been set. The air inside pressure chamber 17 is compressed and forces the liquid through line 19 and connection pipe 6 into the system. When the requisite filling pressure has been reached, valve 21 opens in order to protect the apparatus and the system. When the filling process is terminated, it will be possible once more to carry out a leak test by the closure of valve 10. Prior to separating the apparatus from the system, the multi-way valve 12 is brought into the evacuation position and valves 9, 10 and 22 are opened so that the liquid contained inside connection pipe 6 is withdrawn by suction. It will then be possible to remove connecting piece 7 from filler neck 5 without that any dripping takes place.

In the embodiment example according to FIG. 2, the connection pipe 6 is connectable via the multi-way valve 12 either via line 13 to the suction side of the pump 14 or to a line 24, which can be connected to the pressure side of pump 14 via a multi-way valve 25 via line 26. In the same position of multi-way valve 25, the lines 24 and 26 also remain connected to line 27 which, via the pressure-adjustable excess pressure valve 28, leads back into the liquid storage tank 16. The multi-way valve 25 is readjustable in such a way that it comes to connect the pressure side of the pump 14 and line 16 via a line 29 to the storage tank 16.

The apparatus according to FIG. 2 functions in the following manner. Only the evacuation and the filling operations are described here since the leak tests of the apparatus and the non-dripping removal of connecting piece 7 from the system are the same as in the apparatus according to FIG. 1.

For the evacuation operation, the multi-way valves 12, 25 are set in such a way that pump 14 evacuates the system 1 via the connection pipe 6 and lines 13, 26 and 29 into the storage tank 16. When the desired vacuum in system 1 is reached or when it is evacuated, a changeover to the filling operation is effected in that the suction side of pump 14 is connected to suction line 19 via line 13 and multi-way valve 12, while the pressure side of pump 14 is connected to the connection pipe via lines 26, 24 and multi-way valve 12. When the planned filling pressure is reached, excess pressure valve 28 opens so that the pump feeds back into storage tank 16.

In the embodiment example according to FIG. 3, just as in the embodiment example according to FIG. 1, the connection pipe 6 is connectable via multi-way valve 12 either via line 13 to the suction side of the pump or to suction line 19. The pressure side of the pump is also constantly connected to the pressure chamber of the storage tank via line 15. This storage tank, however, is divided up into a smaller, pressure-resistant tank 16*a* with pressure chamber 17*a* and liquid chamber 18*a* and into a storage tank 16*b* with an upper chamber 17*b* communicating with the atmosphere and with a reserve of liquid 18*b*. Both sections of the storage tank are interconnected via an aperture 30 with valve 31. Pump 14 is constructed as a side channel pump or as a liquid ring pump, to which the operating liquid is supplied via multi-way valve 32 and lines 33 and 34 either from the pressureless tank section 16*b* or the pressure-resistant tank section 16*a*.

Unless a detailed description is given in the following, reference is made to the description given to FIG. 1 with respect to the mode of operation. In the evacuation operation the liquid removed from the system 1 flows via line 15 into the pressure-resistant section 16*a* of the storage tank and fills the same up to the overflow aperture. The level of this overflow aperture has been selected in such a way that an adequate reserve of liquid 18*a* is formed. The excess liquid is fed to the reserve section 18*b*. Valve 31 is open for this purpose. At the same time, multi-way valve 32 is set in such a way that the pump is capable of obtaining the operating liquid via line 33 from the pressureless tank section 16*b*. Valve 31 is closed for the filling operation. The filling pressure now builds up inside the pressure-resistant tank section 16*a*. At the same time, the multi-way valve 32 is operated in such a way that the operating liquid now flows in via line 34 from the pressurized tank section.

This apparatus possesses the advantage that the pressure necessary for the filling operation builds up more rapidly because the pressure chamber 16*a* is relatively small.

According to FIG. 4, the connection pipe 6 communicates via multi-way valve 35 either via line 36 with pressure chamber 17 of the storage tank 16 or via line 37 with the liquid chamber. The suction side of pump 14 is connected via multi-way valve 38 either via line 39 to pressure chamber 17 or, via line 40, it communicates with the atmosphere. The pressure side of pump 14 communicates via multi-way valve 41 either via line 42 with the atmosphere or, via line 43, is connected to pressure chamber 17 which is fitted with an excess pressure valve 21 that can be set to the filling pressure.

The apparatus according to FIG. 4 functions in the following manner.

In the course of the evacuation operation the multi-way valves are operated in such a way that the pump evacuates the system via line 39, pressure chamber 17 and lines 36, 6, in which operation the liquid that may possibly be collected from the system remains in storage tank 16 and pump 14 merely has to feed the air originating from pressure chamber 17, which is conducted into the atmosphere via line 42. In the course of the filling operation, the multi-way valves are operated in such a way that pump 14 sucks in air from the atmosphere via line 40 and compresses the air contained in the pressure chamber 17 via line 43. The excess pressure thus formed in pressure chamber 17 forces the liquid out of the liquid chamber 18 via line 37 and connection pipe 6 into the system.

As the storage tank 16 is subjected to a partial vacuum during the evacuation operation and to an excess pressure during the filling operation, it must be constructed in manner that is both resistant to partial vacuum and to excess pressure. The model according to FIG. 4 possesses the advantage that the pump does not come into contact with the filling liquid. It may be employed if the pump does not tolerate any liquid or when the lubrication fluid and the coolant of the pump is incompatible with the medium.

In order, if necessary, to be able to collect the medium emptied from a system to be evacuated which must not be mixed with other media or which media it might contaminate, it is possible to arrange a collecting vessel located between the system and the apparatus according to the invention which collects the contents of the system. Such a liquid-collecting vessel is illustrated in FIG. 5. It does not communicate with the atmosphere. It receives the medium removed from the system via connection pipe 6 and merely passes on the gas volume present above its reserve of liquid to the apparatus according to the invention via line 44. The liquid collected in the liquid-collecting vessel may, if desired, subsequently be used for refilling the circuit with the aid of compressed air.

We claim:

1. In combined liquid charging and evacuating apparatus having a connector conduit for conducting liquid to and from a separate liquid system and a fluid pumping system for selectively pumping liquid to and drawing it from the connector conduit for respectively charging and evacuating the separate liquid system, the fluid pumping system comprising a liquid storage tank for storing liquid, fluid pump means, and fluid conductor means with selectively operable valve means for selectively connecting the fluid pump means for pumping liquid from the storage tank to the connector conduit for charging the separate liquid system and for pumping liquid from the connector conduit to the storage tank for evacuating the separate liquid system, the improvement wherein the fluid pump means comprises a single fluid pump having a fluid inlet and a fluid outlet and wherein the valve means is selectively operable for selectively connecting the pump inlet and pump outlet for selectively pumping liquid from the storage tank to the connector conduit and from the connector conduit to the storage tank.

2. Liquid charging and evacuating apparatus according to claim 1 wherein the valve means is selectively operable for connecting the fluid pump outlet for pressurizing the storage tank for conducting liquid under pressure from the storage tank to the connector conduit.

3. Liquid charging and evacuating apparatus according to claim 2 wherein the valve means comprises an excess pressure valve for limiting the storage tank pressure.

4. Liquid charging and evacuating apparatus according to claim 2 wherein the storage tank has a relatively small pressure tank section adapted to be pressurized by the fluid pump and a relatively large unpressurized liquid reservoir section and wherein the valve means is selectively operable for selectively conducting liquid between the pressure tank and reservoir sections.

5. Liquid charging and evacuating apparatus according to claim 1 wherein the fluid pump is operable for pumping liquid and gas and wherein the valve means is selectively operable for directly connecting the pump inlet to the connector conduit for drawing liquid therefrom through the pump.

6. Liquid charging and evacuating apparatus according to claim 1 wherein the valve means is selectively operable for connecting the fluid pump inlet for reducing the storage tank pressure for drawing liquid from the connector conduit directly to the storage tank.

7. Liquid charging and evacuating apparatus according to claim 1 wherein the valve means is selectively operable for selectively connecting the pump outlet and pump inlet for selectively pressurizing the storage tank and establishing a partial vacuum in the storage tank respectively for selectively conducting liquid under pressure from the storage tank to the connector conduit and under a partial vacuum from the connector conduit to the storage tank respectively.

8. Liquid charging and evacuating apparatus according to claim 1 further comprising a fluid pressure test gauge connected to the connector conduit for registering the fluid pressure therein and wherein the valve means is selectively operable for selectively partly isolating the connector conduit to provide a pressure leak test with the test gauge.

* * * * *